United States Patent [19]

Stohlquist et al.

[11] 4,375,826

[45] Mar. 8, 1983

[54] CONTAINER FILLING MACHINE

[75] Inventors: Roger H. Stohlquist; Jonathan G. Brown, both of Rockford, Ill.

[73] Assignee: Anderson Bros. Mfg. Co., Rockford, Ill.

[21] Appl. No.: 251,250

[22] Filed: Apr. 6, 1981

[51] Int. Cl.[3] ..... B65B 3/04

[52] U.S. Cl. ..... 141/137; 141/234; 141/284

[58] Field of Search ..... 141/100-105, 141/129-191, 250-284, 234-248

[56] References Cited

U.S. PATENT DOCUMENTS

| | | | |
|---|---|---|---|
| 2,730,284 | 1/1956 | Hutchinson | 141/101 |
| 2,752,083 | 6/1956 | Ullman et al. | 141/102 |
| 2,863,271 | 12/1958 | Anderson et al. . | |
| 3,055,404 | 9/1962 | Anderson . | |
| 3,307,499 | 3/1967 | Bergstrom . | |

*Primary Examiner*—Houston S. Bell, Jr.
*Attorney, Agent, or Firm*—Vernon J. Pillote

[57] ABSTRACT

An apparatus for dispensing material into containers as they are advanced by a conveyor. The dispensing apparatus includes a nozzle having a product outlet at its lower end, a crank connected to the nozzle for moving the nozzle in an upright closed loop course, a dispenser control mounted for oscillation about a swing axis above the crank axis, and mechanism connecting the nozzle to the dispenser control for relative sliding movement so that the nozzle oscillates about the swing axis and also reciprocates relative to the dispenser control as the nozzle is moved in its closed loop course. Valve mechanism on the nozzle is operated between its open and closed positions in response to reciprocation of the nozzle toward and away from the dispenser outlet.

19 Claims, 11 Drawing Figures

3
56
53
51
52
35
SA
26
45
47
73
CA
72
46
23a
42
34
33
37
38
3
21
32
36
31

CONTAINER FILLING MACHINE

BACKGROUND OF THE INVENTION

Filling machines have heretofore been made for filling containers while they were being advanced by a conveyor, and in which the nozzle has a component of movement in the direction of movement of the container during the dispensing operation. In U.S. Pat. Nos. 2,863,271 and 3,055,404, a rotary valve member is mounted on an internal valve stator for rotation relative thereto about a generally horizontal axis above the conveyor, with a plurality of circumferentially spaced nozzles on the rotary valve member adapted to register with a port in the valve stator during a part of each revolution of the valve member to dispense product into the moving container. In such rotary valves, the nozzles can dispense product into the container moving therebelow only during a relatively small portion of each revolution of the valve member and they require relatively large diameter valve members in order to increase the distance through which each nozzle and a respective container travel during dispensing of material into the container. It has also been proposed, as shown in U.S. Pat. No. 3,307,499, to mount a nozzle member on the crank pins of upper and lower cranks which move the nozzle in an orbital path while maintaining the nozzle vertical with its outlet end facing downwardly. In that apparatus, the outlet end of the nozzle moves in a circular path having a radius corresponding to that of the crank and, if the crank radius is increased to increase the horizontal component of movement of the nozzle outlet, the vertical component movement of the nozzle outlet will be correspondingly increased and the nozzle speed will not approximate the container motion. Further, although rotary valves are satisfactory for dispensing relative viscous products, they are difficult to seal and leak excessively when used for dispensing low viscosity liquids.

SUMMARY OF THE INVENTION

It is the object of the present invention to overcome the disadvantages of the prior art by providing a machine for filling containers as they are advanced by a conveyor and having an improved arrangement for moving the dispensing nozzle so that the product outlet travels in an oblate closed loop course above the conveyor with the major dimension of the oblate course paralleling the path movement of the containers by the conveyor to increase the fill time, while minimizing vertical travel of the product outlet.

Another object of this invention is to provide a filling machine for filling containers as they are advanced by a conveyor, which can be used to dispense liquids of low viscosity.

Still another object of this invention is to provide a filling machine using several valved dispensers for filling containers as they are advanced by a conveyor, and in which the portion of the dispensing cycle during which the valve on each dispenser is open can be readily adjusted to optimally control flow from the several dispensers.

Accordingly, the present invention provides a filling machine having a conveyor for advancing containers along a generally horizontal path and at least one valved dispenser assembly having a product inlet and a product outlet for dispensing product into the containers as they are advanced by the conveyor, the valved dispenser assembly including an elongated nozzle having the product outlet at its lower end, a crank means mounted on the stationary support for rotation about a generally horizontal crank axis and having an eccentric rotatably connected to the nozzle member to move the nozzle member in a generally upright closed loop course having horizontal and vertical components of movement, means for driving the crank in timed relation with the conveyor and such that the horizontal component of movement of the nozzle is in the direction of movement of the conveyor during the lower half of the closed loop course and in the opposite direction during the upper half of the closed loop course, dispenser control means mounted on the stationary support structure for angular oscillation about a generally horizontal swing axis above the crank axis, means connecting the nozzle member on the dispenser control means for relatively sliding movement in a direction paralleling the nozzle axis to cause the nozzle member to oscillate angularly about the swing axis and reciprocate relative to the dispenser control as the nozzle is moved in its closed loop course, valve means on the nozzle member movable between a closed position blocking flow from the product inlet to the product outlet and an open position for passing product from the product inlet to the product outlet, and valve actuator means for moving the valve means between its open and closed positions in response to relative reciprocatory movement between the nozzle member and the dispenser control means, the last mentioned means being operative to move the valve means to its open position as the nozzle member moves through at least a portion of the lower half of the closed loop portion of the nozzle member and to move the valve means to its closed position during the remainder of the closed loop course.

The valve member is advantageously slidably connected to the nozzle member for relative reciprocatory movement along the nozzle axis and the valve actuating means is arranged to limit relative sliding movement between the dispenser control means and the valve member to control opening and closing of the valve means.

These, together with other objects, features and advantages of this invention will be more readily understood by reference to the following detailed description when taken in connection with the accompanying drawings wherein.

Figure 1:
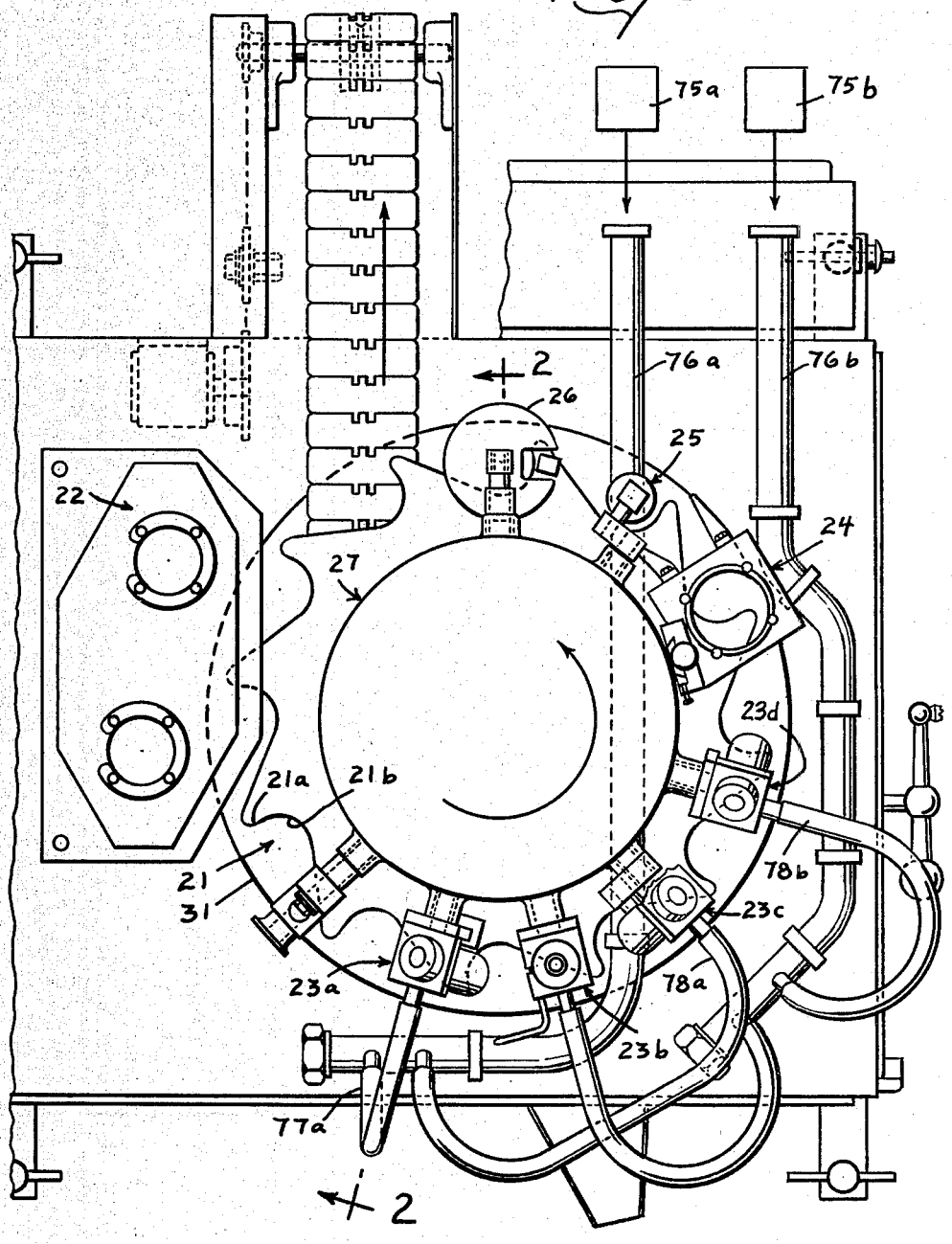
FIG. 1 is a top plan view of the filling machine.

The container filling apparatus of the present invention is arranged to fill containers as they are continuously advanced and, as best shown in FIG. 1, includes a conveyor 21 for advancing containers in continuous fashion along a generally horizontal path and at least one and preferably a plurality of valved dispenser assemblies, herein shown four in number and designated 23*a*–23*d*, arranged to dispense product into the containers as they are advanced by the conveyor. The filling machine can also conveniently include a container dispensing mechanism 22 for feeding empty containers to the conveyor, a cover dispenser mechanism 24 for dispensing covers, and a cover applying mechanism 25, 26 for applying the covers to the containers.

Figure 2:
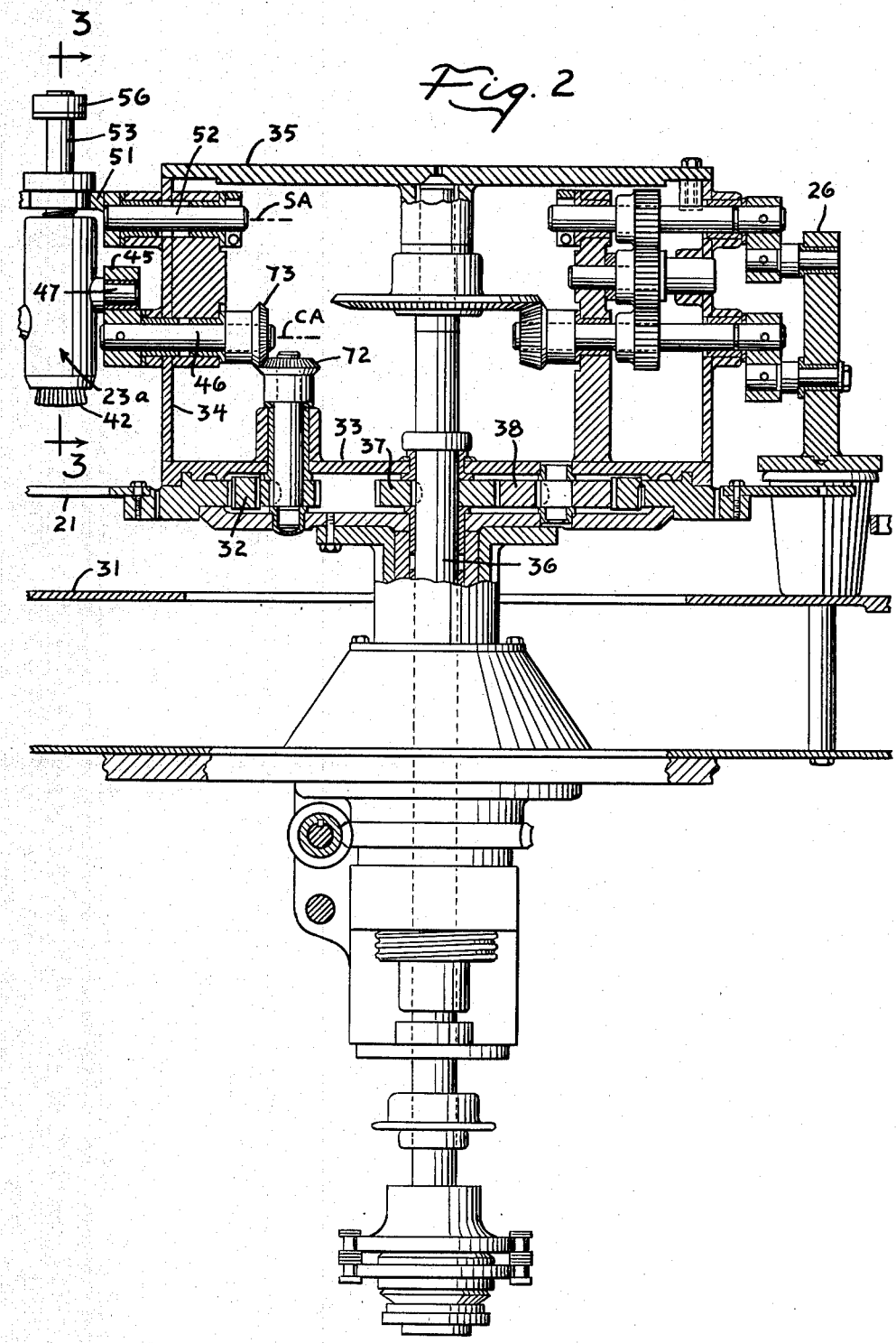
FIG. 2 is a vertical sectional view through the filling machine taken on the plane 2—2 of FIG. 1.
Figure 3:
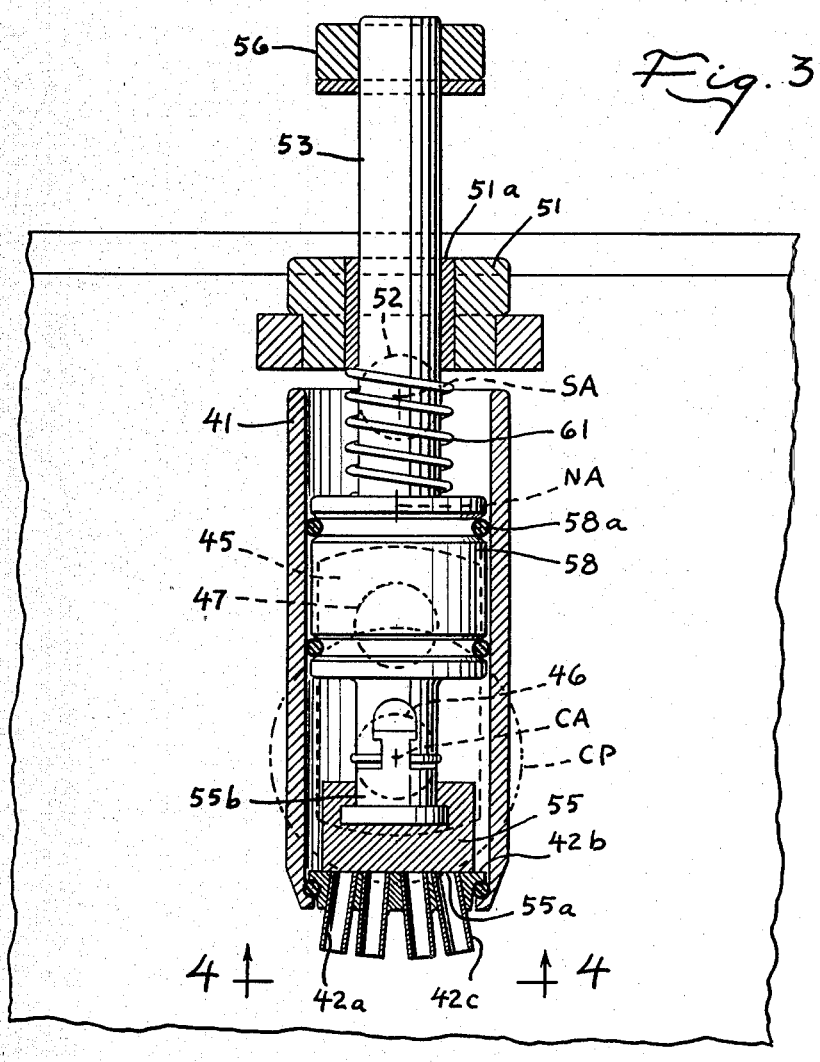
FIG. 3 is a fragmentary vertical sectional view taken on the plane 3—3 of FIG. 2.
Figure 4:
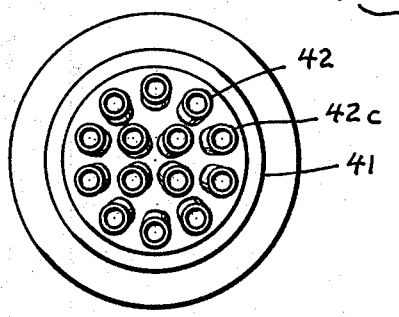
FIG. 4 is a view of the outlet nozzle taken on the plane 4—4 of FIG. 3.
Figure 5:
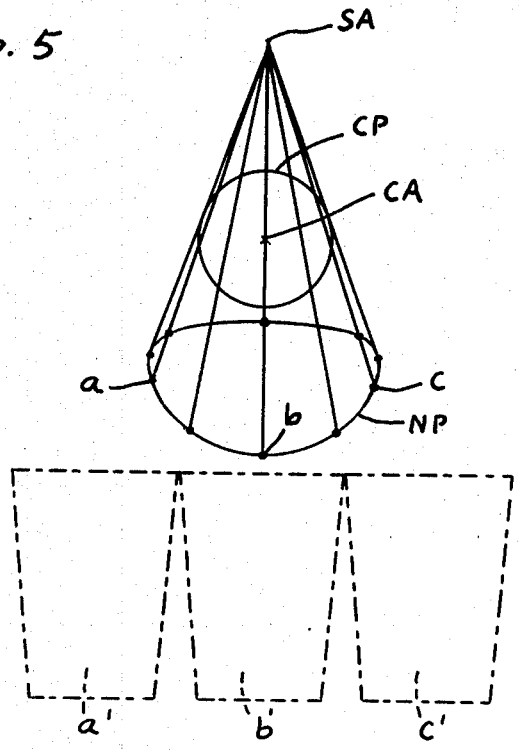
FIG. 5 is a schematic view illustrating the path of movement of the nozzle member during a dispensing cycle.
Figure 6:
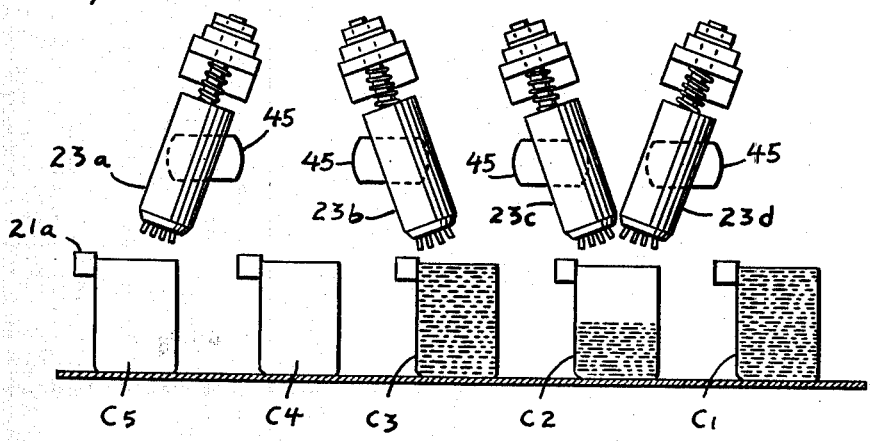
FIGS. 6, 7, 8 and 9 are diagrammatic views illustrating the nozzle members on the filling machine in different moved positions.
Figure 7:
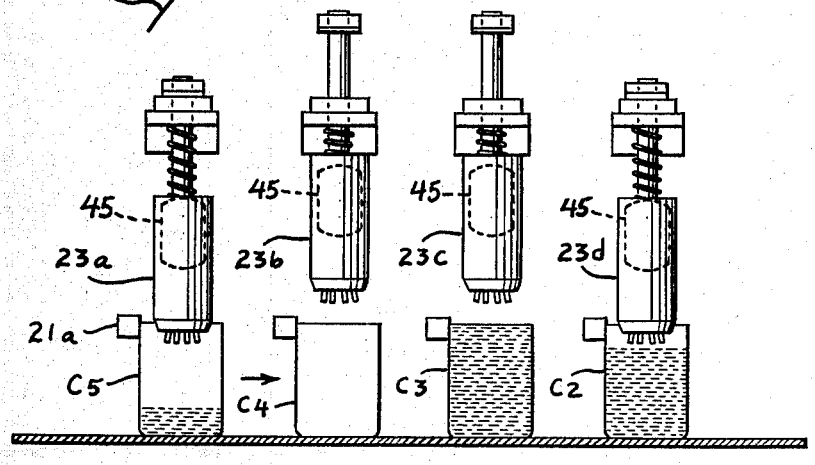
Figure 8:
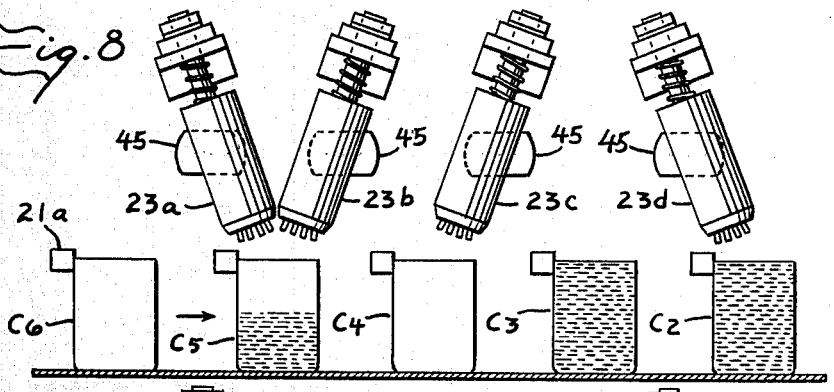
Figure 9:
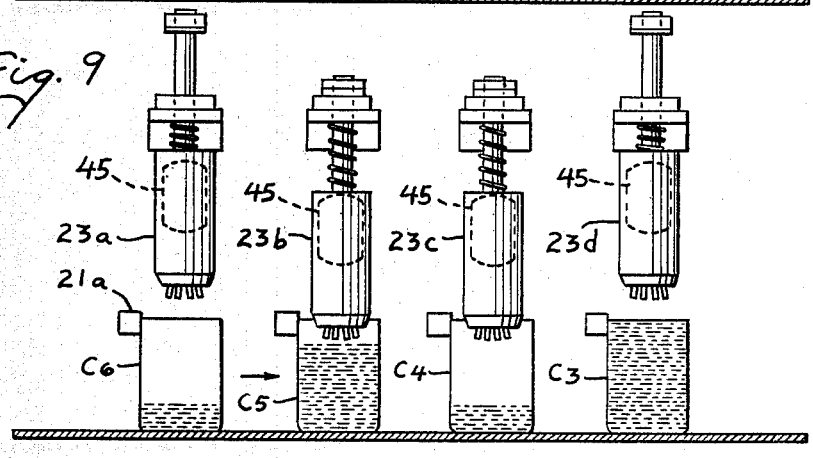

In the embodiment illustrated, the conveyor 21 and the drive therefor are of the type disclosed in U.S. Pat. No. 2,863,271 to which reference is hereby made for a more complete disclosure and description. In general, the conveyor 21 is annular in form and includes a plurality of outwardly extending teeth 21*a* that define container pockets 21*b* therebetween and which are arranged to advance containers along a generally horizontal container suyport platform 31. As best shown in FIG. 2, the conveyor 21 is mounted on a ring gear 32 that is rotatably supported on a stationary central housing 27 having a bottom wall 33, peripheral side walls 34 and top wall 35. A central vertically disposed drive shaft 36 is operatively connected to a drive motor (not shown) in a manner more fully disclosed in the aforementioned patent, and the drive shaft 36 is connected through spur gear 37 and idler gears 38 to the ring gear 32 to rotate the ring gear in response to rotation of the drive shaft 36.

The valved dispenser assemblies 23*a*–23*d* are of like construction and like numerals are used to designate corresponding parts. Each dispenser assembly includes an elongated nozzle member 41 having a longitudinal nozzle axis indicated by the line NA and a product outlet 42 at its lower end and a product inlet 43 spaced from the nozzle outlet. The nozzle members are driven by a crank 45 mounted on a shaft 46 rotatably supported on the side wall 34 of the stationary housing for rotation about a generally horizontal crank axis designated CA spaced above the conveyor. Each crank has an eccentric crank pin 47 which rotates in a circular path designated CP and which is connected to the nozzle member for relative rotary movement therebetween to move the nozzle member in a generally upright closed loop course having horizontal and vertical components of movement. Each dispenser assembly also includes a dispenser control means 51 mounted on the stationary housing 27 by a pin 52 and which supports the dispenser control means 51 for angular oscillation about a generally horizontal swing axis SA above the crank axis. A means is provided for connecting the nozzle member 41 and the dispenser control means 51 for relatively sliding movement in a direction paralleling the nozzle axis NA, to cause the nozzle member to oscillate angularly about the swing axis and reciprocate relative to the dispenser control means 51 as the nozzle member is moved in its closed loop course. In the embodiments illustrated, this means includes an elongated rod 53 that parallels the nozzle axis and which is slidably supported in a bearing 51*a* on the dispenser control means 51.

A valve means 55 is provided on the nozzle member for controlling flow from the product inlet 43 to the producoutlet 42, and a valve actuator means 56 is provided for moving the valve means between its open and closed positions in response to relative reciprocatory movement between the nozzle member and dispenser control member 51. In the embodiment of FIGS. 1–8, the nozzle member 41 has a cylindrical configuration and the valve member 55 is mounted on a plug or slide 58 slidably supported in the nozzle member for relatively reciprocatory movement along the nozzle axis. The product outlet means 42 on the nozzle member includes at least one and preferably a plurality of downwardly opening discharge ports 42*a* at the lower end of the nozzle member and a discharge valve seat means 42*b* disposed transverse to the valve axis and extending around each of the ports 42*a*. The valve member 55 is of the face seating type and has a valve face 55*a* disposed transverse to the nozzle axis and which is movable with the nozzle member into and out of engagement with the discharge valve seats 42*b* in response to relative reciprocation of the nozzle member and valve member. In the preferred embodiment, the valve member 55 is conveniently formed of resilient elastomeric material such as rubber or the like and has a mounting member 55*b* detachably keyed as 55*c* to the slide 58. The valve member is yieldably urged to its closed position as by a spring 61 interposed between the valve slide 58 and the dispenser control member 51, and the valve slide is slidably sealed to the nozzle member as by O-ring seals 58*a*.

The valve actuator 56 is arranged to move the valve member to its open position as the nozzle member moves through at least a portion of the lower half of its closed loop course, and to move the valve member to its closed position during the remainder of the closed loop course. In the embodiment of FIGS. 1–8, the valve actuator 56 includes a stop mounted on the rod 53 for adjustment therealong and which is arranged to engage the dispenser control means 51 as the nozzle member is moved through a portion of the lower half of its closed loop course. The valve actuator 56 is arranged to limit downward movement of the valve member to a distance less than the vertical component of movement of the nozzle member in its closed loop course and, when the valve actuator 56 engages the dispenser control member 51 during the lower portion of the closed loop course, the valve member is opened to allow dispensing of product through the product outlet.

The face seal type valve is effective to prevent leakage of even low viscosity liquids through the ports when the valve is closed. However, in order to minimize splashing and foaming in the container and to inhibit dripping of low viscosity liquids from the nozzle when the valve member is closed, the discharge ports are preferably arranged to provide a plurality of elongated passages that direct the liquid in separate streams into the container. Each passage has a cross-section that is sufficiently small to substantially inhibit drainage of product therefrom when the valve is closed. In the preferred embodiment illustrated, the product outlet means includes a plurality of tubes 42*c*, herein shown 14 in number, and having a relatively small internal diameter, preferably of the order of 0.180 inches. When dispensing more products when splashing and foaming are not a problem, the product outlet means can be in the form of a single orifice or opening.

The crank of each valved dispenser assembly is driven in timed relation with the conveyor such that the horizontal component of movement of the nozzle member is in the direction of movement of the conveyor during the lower half of the closed loop course and in the opposite direction during the upper half of the closed loop course. As best shown in FIG. 2, the cranks 45 are driven as by a power take-off gear 71 that meshes with the conveyor ring gear 32, and through beveled gears 72 and 73.

Each valved dispenser assembly only dispenses product during the lower half of its closed loop course and the nozzle on the valved dispenser assembly is driven at a speed so that the horizontal component of the movement of the product outlet closely approximates the speed of movement of the container being advanced below the nozzle by the conveyor. The teeth 21*a* on the conveyor are arranged to advance the containers along the path with the centers of the containers spaced apart a preselected container pitch distance equal to the spacing of corresponding points on adjacent teeth. The first valved dispenser assembly 23*a* is driven at a speed to complete one revolution during the time the conveyor advances a distance corresponding to twice the conveyor pitch distance and are timed so that the nozzle outlet is at its bottom dead center position when the container being filled is substantially centered below the nozzle. Thus, each valved dispenser will dispense product into alternate ones of the containers. At least one other valved dispenser assembly is provided and spaced along the conveyor path and driven in timed relation with the first mentioned valved dispenser so as to dispense product into containers intermediate those filled by the first valved dispenser assembly. In order to further increase the speed of filling, each valved dispenser assembly can be arranged to dispense only a portion of the total amount of product into each container. For example, if each valved dispenser assembly is arranged to dispense only one-half of the total amount of product, then four valved dispenser assemblies 23*a*–23*d* are provided with two of the valved dispenser assemblies such as 23*a* and 23*b* arranged to dispense product into the same container and two other valved dispenser assemblies 23*c* and 23*d* arranged to dispense product into different containers. FIGS. 6–9 diagrammatically illustrate four valve dispensers 23*a*–23*d* dispensing product into a series of containers C1–C6. When four valve dispenser assemblies are utilized, it is preferable to use two positive displacement type product pumps 75*a* and 75*b* and to connect one pump 75*a* through pipe 76*a* and flexible tubes 77*a* and 78*b* to two valved dispensers 23*a* and 23*c* that dispense into different containers and to connect the other pump 75*b* through pipe 76*b* and flexible tubes 77*b* and 78*b* to two other dispensers 23*b* and 23*d* that dispense into different containers. The positive displacement pumps 75*a* and 75*b* are driven from a motor through separate variable speed drives (not shown) to enable adjustment of the rate of delivery of product to the valved dispensers to vary the amount of material dispensed into the containers. The valve actuators 56 are adjusted to vary the portion of the cycle during which each valve means is open. Preferably the valve actuators for the pair of valved dispensers that are connected to the same product pump are adjusted so that the valve means on one valved dispenser commences opening just before the valve means on the other valved dispenser closes to thereby allow a substantially continuous flow of product from the product pump through one or the other of the valved dispensers connected thereto.

Figure 10:
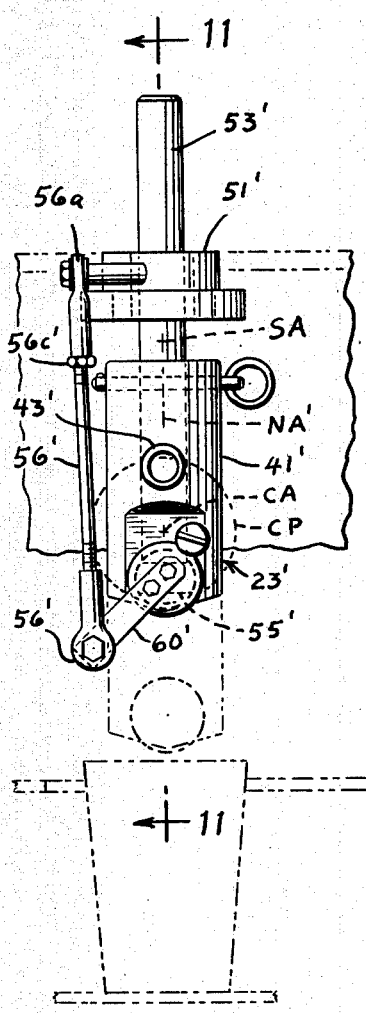
FIG. 10 is a front elevational view of a modified form of valved dispenser assembly.
Figure 11:
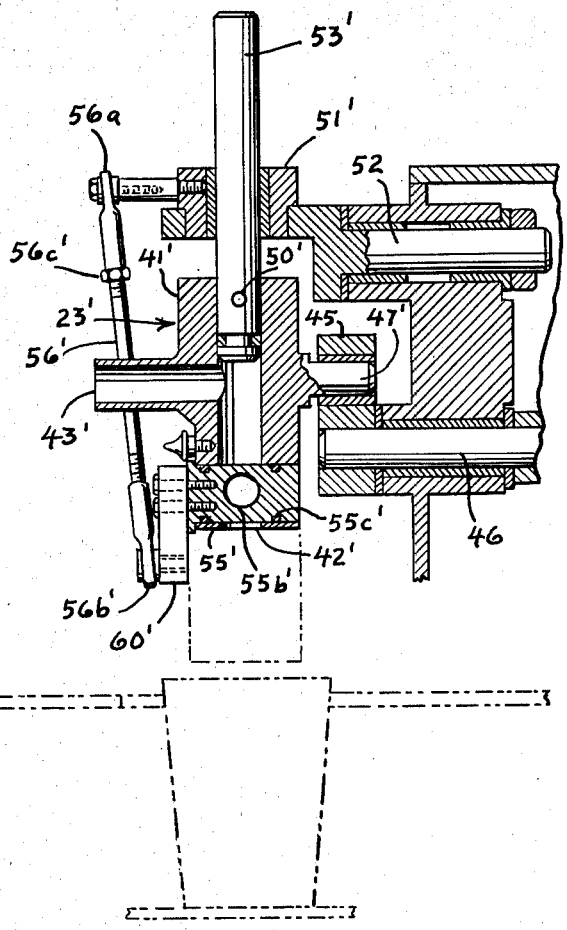
FIG. 11 is a vertical sectional view taken on the plane 11—11 of FIG. 10.

A modified form of valved dispenser assembly is illustrated in FIGS. 10 and 11. In this embodiment, like numerals are used to designate the same parts as described in connection with the embodiment of FIGS. 1–9, and like numerals followed by the postscript ′ are used to designate similar or modified parts. The valved dispenser assembly 23′ includes an elongated nozzle member 41′ having a nozzle axis NA′ and a product outlet 42′ at its lower end and a product inlet 43′ spaced from the product outlet. The nozzle member 41′ is connected by an eccentric crank pin 47′ to the crank 45 for movement in a generally upright closed loop course having horizontal and vertical components. A dispenser control means 51′ is mounted on the pin 52 for angular movement about swing axis SA spaced above the crank axis CA and a rod 53′ is connected to the nozzle member as by a pin 50′ and is slidably supported in the bearing 51*a′* in the dispenser control means 51 to cause the nozzle member to oscillate angularly about the swing axis and reciprocate relative to the dispenser control means as the nozzle member is moved in its closed loop course by the crank means. In this embodiment, a plug type valve member 55′ is mounted in a transverse bore 55*a′* in the nozzle member for angular oscillation relative thereto. The plug member has a transverse flow passage 55*b′* which is movable between a closed position shown in FIG. 11 out of communication with the product outlet 42′, and an open position in which the passage 55*b′* registers with the product outlet. O-ring seals 55*c′* are provided on the plug valve member to seal against the bore 55*a′* at opposite sides of the flow passage 55*b′*.

Valve actuating means is provided for moving the plug valve member 55′ between its open and closed positions in response to reciprocation of the nozzle member toward and away from the dispenser control means. For this purpose, a link 56′ is swivelly connected at one end 56*a′* to the dispenser control means 51′ and is swivelly connected at its other end 56*b′* to an arm 60′ that extends generally radially from the plug valve member. The length of the arm 60′ is selected so that the plug valve member will oscillate through approximately 90° between its open and closed positions as the nozzle member moves toward and away from the dispenser control means. Advantageusly, the link 56′ is made threadedly adjustable as shown at 56*c′* to enable adjustment of the portion of the closed loop course of the nozzle member during which the valve means is open.

From the foregoing it is believed that the construction and operation of the filling machine will be readily understood. Each crank pin 42 rotates in an upright circular path CP and moves its nozzle member through a generally upright closed loop course having horizontal and vertical components. The dispenser control means of each dispenser assembly is mounted for oscillating movement about a horizontal swing axis SA above its crank axis CA and is connected to the nozzle member for relative sliding movement in a direction paralleling the nozzle axis so that each nozzle member oscillates angularly about its swing axis and also reciprocates relative to its dispensing control means as the nozzle member is moved in its closed loop course. As diagrammatically shown in FIG. 5, this causes the product outlet 42 at the lower end of the nozzle member to move in an oblong closed loop course NP having its major dimension lengthwise of the path of movement of the containers by the conveyor so that the nozzle outlet registers with a moving container being advanced therebelow as the container is advanced a substantial distance along the conveyor path. Further, the relatively long horizontal component of movement of the lower end of the nozzle member is achieved without correspondingly increasing the vertical component of movement of the lower end of the nozzle member so that the product outlet on the nozzle member remains relatively close to the level of the top of the container during the dispensing operation. The conveyor 21 advances the containers C at a uniform speed along a path below the valved dispenser assemblies 23*a*–23*d* and the product outlet of each nozzle substantially follows the movement of a container as the nozzle moves through the lower portion of its closed loop course NP. Container positions diagrammatically shown at a, b and c' in FIG. 5 correspond generally to nozzle outlet positions a, b and c, that is the nozzle outlet positions at 90°, 180° and 270° from crank top dead center.

Movement of the valve member between the open and closed positions is effected in response to reciprocation of the nozzle member relative to the dispenser control member, and the portion of each cycle during which the valve is open can be readily adjusted to vary the amount of material dispensed during each cycle. In the embodiment of FIGS. 1–9, the valve actuator 56 is adjustable along the rod 53*a* to control the portion of the cycle during which the valve members 55 are opened. In the embodiment in FIGS. 10 and 11, the linkage 56' is adjustable to vary the portion of the cycle during which the plug valve member 55' is opened. In general, the valve member is opened only during the lower half of the closed loop course NP and preferably between the nozzle outlet position diagrammatically shown at a and c in FIG. 5.

The reciprocating valve shown in FIGS. 1–9 is particularly advantageous for use in dispensing liquids of low viscosity. The oscillating valve shown in the embodiment of FIGS. 10 and 11 can be utilized for dispensing relative viscous materials and is particularly suited for dispensing those materials such as ice cream containing nuts, fruits, or the like.

The embodiments of the invention in which an exclusive property or privilege is claimed are defined as follows:

1. A filling machine having a stationary support structure, conveyor means for advancing containers along a generally horizontal path with adjacent container centers spaced apart a preselected conveyor pitch distance, at least one valved dispenser assembly having product inlet means and product outlet means for dispensing product into the containers as they are advanced by the conveyor means, the valved dispenser assembly including an elongated nozzle member having a longitudinal nozzle axis and said product outlet means at its lower end, crank means mounted on the stationary support for rotation about a generally horizontal crank axis and having an eccentric connected to the nozzle member to move the nozzle member in a generally upright closed loop course having horizontal and vertical components of movement, means for driving the crank means in timed relation with the conveyor means and such that the horizontal component of movement of the nozzle member is in the direction of movement of the conveyor means during the lower half of the closed loop course and in the opposite direction during the upper half of the closed loop course, dispenser control means mounted on the stationary support structure for angular oscillation about a generally horizontal swing axis above said crank axis, means connecting the nozzle member and the dispenser control means for relative sliding movement in a direction paralleling the nozzle axis to cause the nozzle member to oscillate angularly about the swing axis and reciprocate relative to the dispenser control means as the nozzle member is moved in said closed loop course, valve means on the nozzle member movable between a closed position blocking flow from the product inlet to the product outlet and an open position for passing product from the product inlet to the product outlet, and valve actuator means for moving the valve means between its open and closed positions in response to relative reciprocatory movement between the nozzle member and the dispenser control means, said last mentioned means being operative to move the valve means to its open position as the nozzle member moves through at least a portion of the lower half of said closed loop course of the nozzle member and to move the valve means to its closed position during the remainder of the closed loop course.

2. A filling machine according to claim 1 wherein said valve actuator means is adjustable to vary the portion of the closed loop course during which the valve means is open.

3. A filling machine according to claim 1 wherein said valve means includes a valve member slidably mounted on said nozzle member for movement relative thereto along said nozzle axis between its open and closed positions.

4. A filling machine according to claim 1 wherein said valve means includes a valve member slidably mounted on said nozzle member for movement relative thereto along said nozzle axis between its open and closed positions, said valve actuator means limiting relative sliding movement between the dispenser control means and the valve member to a distance less than the vertical component of movement of the nozzle member in said closed loop course.

5. A filling machine according to claim 4 wherein said product outlet means includes outlet port means at the lower end of the nozzle member and outlet valve seat means extending around the outlet port means and disposed transverse to the nozzle axis, said valve means including a valve face means on the valve member disposed transverse to the nozzle axis and engageable with outlet valve seat means.

6. A filling machine according to claim 5 wherein said discharge port means includes a plurality of passages each having a cross-section sufficiently small to substantially inhibit draining of product therefrom when the valve face means on the valve member engages the valve seat means on the nozzle member.

7. A filling machine according to claim 5 wherein said means connecting the nozzle member and dispenser control means includes a rod paralleling the nozzle axis and mounted for axial sliding movement on the dispenser control means.

8. A filling machine according to claim 1 wherein said valve means includes a valve member mounted on the nozzle member for angular oscillation relative thereto, said valve actuator means connecting the valve member to the dispenser control means to effect angular oscillation of the valve member in response to reciprocation of the nozzle member toward and away from the dispenser control means.

9. A filling machine according to claim 8 wherein said valve actuator means includes an arm on the valve member extending laterally from the valve member and a link connecting said arm to said dispenser control means.

10. A filling machine according to claim 9 wherein said link is adjustable to vary the portion of each dispensing cycle during which material is dispensed.

11. A filling machine having a stationary support structure, conveyor means for advancing containers along a generally horizontal path with adjacent container centers spaced apart a preselected conveyor pitch distance, at least one valved dispenser assembly having product inlet means and product outlet means for dispensing product into the containers as they are advanced by the conveyor means, the valved dispenser assembly including an elongated nozzle member having a longitudinal nozzle axis and the product outlet means at its lower end, a valve member slidably connected to the nozzle member for relative reciprocatory movement along the nozzle axis, crank means mounted on the stationary support structure for movement about a generally horizontal crank axis above the conveyor means and having an eccentric conconnected to the nozzle member to move the nozzle member in a generally upright closed loop course having horizontal and vertical components of movement, means for driving the crank means in timed relation with the conveyor means and such that the horizontal component of movement of the nozzle member is in the direction of movement of the conveyor means during a lower half of the closed loop course and in the opposite direction during the upper half of the closed loop course, dispenser control means mounted on the stationary support structure for angular oscillation about a generally horizontal swing axis above said crank axis, means connecting the dispenser control means to the valve member to cause the valve member and nozzle member to oscillate angularly about said swing axis as the nozzle member moves in said closed loop course, said last mentioned means including valve actuator means for controlling vertical movement of the valve member to effect relative reciprocation of the valve member and nozzle member along the nozzle axis when the nozzle member is moved through at least a portion of said closed loop course, and valve means on the valved dispenser assembly for controlling flow from the product inlet means to the product outlet means and operative in response to relative reciprocatory movement between the valve member and nozzle member to open the valve means and pass product from the product inlet means to the product outlet means during at least a portion of said lower half of the closed loop course of the nozzle member and to close and shut off flow of product from the product inlet means to the product outlet means during the remainder of the closed loop course.

12. A filling machine according to claim 11 wherein said valve actuator means is adjustable to vary the portion of the closed loop course during which the valve means is open.

13. A filling machine according to claim 11 wherein the eccentric on the crank means is connected to the nozzle member at a location spaced a substantial distance above the product outlet means at its lower end.

14. A filling machine according to claim 11 wherein said means operatively connecting the dispenser control means to the valve member includes means slidably supporting the valve member on the dispenser control means for relative sliding movement in a direction paralleling the nozzle axis, said valve actuator means limiting relative sliding movement between the dispenser control means and the valve member to a distance less than the vertical component of movement of the nozzle member in said closed loop course.

15. A filling machine according to claim 11 wherein said product outlet means includes discharge port means at the lower end of the nozzle member and discharge valve seat means on the nozzle member disposed transverse to the nozzle axis, said valve means including valve face means on the valve member disposed transverse to the nozzle axis and movable into and out of engagement with the discharge valve seat means in response to relative reciprocation of the nozzle member and valve member.

16. A filling machine according to claim 15 wherein said discharge port means includes a plurality of passages each having a cross-section sufficiently small to substantially inhibit drainage of product therefrom when the valve face means on the valve member engages the valve seat means on the nozzle member.

17. A filling machine according to claim 11 wherein said filling machine includes at least a second one of said valved dispenser assemblies, said valved dispenser assemblies being spaced apart in a direction paralleling the conveyor path a distance equal to a multiple of the conveyor pitch distance, and means for driving the second valved dispenser assembly in a predetermined phase relation to the first mentioned valved dispenser assembly and such that the second valved dispenser assembly dispenses product into containers intermediate the containers into which the first valved dispenser assembly dispenses product.

18. A filling machine according to claim 11 wherein said filling machine includes a second, and third and a fourth one of said valved dispenser assemblies, said valved dispenser assemblies being spaced apart in a direction paralleling said path a distance equal to the conveyor pitch distance, and means for driving said second, third and fourth valved dispenser assemblies in predetermined phase relation with the first mentioned valved dispenser assembly such that the two of valved dispenser assemblies sequentially dispense product into one container as it is advanced by the conveyor means and two other of valved dispenser assemblies sequentially dispense product into an adjacent container as it is advanced by the conveyor means.

19. A filling machine having a stationary support structure, conveyor means for advancing containers along a generally horizontal path with adjacent container centers spaced apart a preselected conveyor pitch distance, at least one valve dispenser assembly having product inlet means and product outlet means for dispensing product into the containers as they are advanced by the conveyor means, the valved dispenser assembly including an elongated nozzle member having a longitudinal nozzle axis and said product outlet means at its lower end, crank means mounted on the stationary support for rotation about a generally horizontal crank axis and having an eccentric connected to the nozzle member to move the nozzle member in a generally upright closed loop course having horizontal and vertical components of movement, means for driving the crank means in timed relation with the conveyor means and such that the horizontal component of movement of the nozzle member is in the direction of movement of the conveyor means during the lower half of the closed loop course and in the opposite direction during the upper half of the closed loop course, dispenser control means mounted on the stationary support structure for angular oscillation about a generally horizontal swing axis above said crank axis, means connecting the nozzle member and the dispenser control means for relative sliding movement in a direction paralleling the nozzle axis to cause the nozzle member to oscillate angularly about the swing axis and reciprocate relative to the dispenser control means as the nozzle member is moved in said closed loop course, valve means on the nozzle member movable between a closed position blocking flow from the product inlet to the product outlet and an open position for passing product from the product inlet to the product outlet, and valve actuator means for moving the valve means to its open position as the nozzle member moves through at least a portion of the lower half of said closed loop course of the nozzle member and to its closed position during the remainder of the closed loop course.

* * * * *